US005758251A

United States Patent [19]

Takahashi et al.

[11] Patent Number: 5,758,251

[45] Date of Patent: May 26, 1998

[54] IMAGE FORMING APPARATUS HAVING AUTOMATIC DUPLEX DEVICE

[75] Inventors: Atsushi Takahashi; Susumu Kurihara; Utami Soma, all of Hachioji, Japan

[73] Assignee: Konica Corporation, Japan

[21] Appl. No.: 724,064

[22] Filed: Sep. 30, 1996

[30] Foreign Application Priority Data

Oct. 2, 1995 [JP] Japan ..... 7-254873

[51] Int. Cl.[6] ..... G03G 15/00

[52] U.S. Cl. ..... 399/395; 399/18; 399/410; 271/188; 270/58.08

[58] Field of Search ..... 399/18, 394, 395, 399/396, 410, 401; 271/298, 188; 270/37, 52.15, 58.09, 58.07, 58.08, 58.12

[56] References Cited

U.S. PATENT DOCUMENTS

| | | | |
|---|---|---|---|
| 4,025,187 | 5/1977 | Taylor et al. | 399/394 |
| 4,511,242 | 4/1985 | Ashbee et al. | 399/395 |
| 4,917,366 | 4/1990 | Murakami et al. | 270/37 X |
| 5,057,874 | 10/1991 | Miyazaki et al. | 399/396 |
| 5,136,342 | 8/1992 | Ida et al. | 399/396 |
| 5,157,449 | 10/1992 | Matsuno et al. | 399/395 |
| 5,260,757 | 11/1993 | Frank et al. | 399/396 |
| 5,355,206 | 10/1994 | Maruyama et al. | 399/396 |
| 5,543,909 | 8/1996 | Quesnel | 399/394 |

FOREIGN PATENT DOCUMENTS 6-191177 7/1994 Japan .

*Primary Examiner*—Matthew S. Smith

*Attorney, Agent, or Firm*—Jordan B. Bierman; Bierman, Muserlian and Lucas

[57] ABSTRACT

An image forming apparatus includes an image carrier for forming an image thereon; a sheet feeding device for feeding a recording sheet to the image carrier to transfer the image onto the recording sheet; a reversing device for reversing the recording sheet on one side of which the image has been transferred and then which has been fixed, at a conveyance path in the reversing device and for feeding the recording sheet onto the image carrier to form another image on a rear side of the recording sheet; a detection device provided between the conveyance path and the image carrier for optically detecting an amount of skew or an mount of shift of the recording sheet. The apparatus further includes controller for judging the amount of skew or the amount of shift to be malfunctional when the amount of skew or the amount of shift exceeds a predetermined value, and for modifying image forming conditions thereafter.

6 Claims, 3 Drawing Sheets

IMAGE FORMING APPARATUS HAVING AUTOMATIC DUPLEX DEVICE

BACKGROUND OF THE INVENTION

The present invention relates to an image forming apparatus capable of forming an image on both sides of a recording sheet.

There is an image forming apparatus wherein a recording sheet is conveyed from a paper feeding means to an image carrier section so that an image is transferred onto aforesaid recording sheet for forming and, after fixing aforesaid image transferred onto aforesaid recording sheet, aforesaid recording sheet is reversed in a re-conveyance path, and then, another image is formed on the rear side of the recording sheet in the image carrier section a gain.

In the above-mentioned image forming apparatus, skewing or shifting in a direction perpendicular to a feeding direction results wherein the recording sheet is slid to a perpendicular direction against the conveyance direction. As a result, images formed on the recording sheet is sfifted or the recording sheet is wrinkled. Therefore, a countermeasure, that skewing is physically corrected by temporarily forming an upward curl of a recording sheet by pushing a leading edge of the recording sheet toward rollers prior to feeding the recording sheet to the image carrier section and, concurrently with this, the position of the image on the image carrier is registered with that of the recording sheet, is conventionally taken.

However, in the case when excessive skewing or shifting of more than regulation occurs due to correction of the present system, the recording sheet may be clogged inside the conveyance path. Accordingly, it is conventional that, if the skewing or shifting is detected and it is more than regulation, operation is stopped as jamming occurred or alarm is displayed. In such cases, there was inconvenience that image formation could not be continued.

In addition, there may be cases when an image forming apparatus is provided with a discharging collating device having s staple sort mode which aligns plural recording sheet and binds them. In these cases, when stapling, wherein plural recording sheet is aligned and bound by means of the staple sort mode, defective stapling may occur when the recording sheet is not properly aligned at the stapling position.

In addition, the skewing cannot be corrected perfectly even if the upward curl is formed in the register control section. In these occasions, wrinkling occurs due to crushing of the recording sheet by the register rollers.

Specifically, in the case of an automatic duplex unit (ADU) wherein recording media are not stacked in the re-conveyance path, it is difficult to correct skewing or shifting in an intermediate tray and the recording sheet receives heat stress in the fixing section. Accordingly, cases wherein skewing occurs on the recording sheet from the re-conveyance path may frequently occur. Therefore, it has been necessary to take actions against the skewing.

SUMMARY OF THE INVENTION

The present invention was made against the above-mentioned problems. An object of the present invention is to provide an image forming apparatus which can achieve high efficiency of copying operation and improvement in terms of reliability even when skewing or shifting occurs.

In order to solve the above-mentioned problem and attain the object, Structure 1 is an image forming apparatus, wherein a recording sheet is conveyed from a paper feeding means to an image carrier section so that an image is transferred onto aforesaid recording sheet for forming and, after fixing aforesaid image transferred onto aforesaid recording sheet is fixed, aforesaid recording sheet is reversed in a re-conveyance path, and then, another image is formed on the rear side of the recording sheet in the image carrier section again, having a detection means which optically detects the amount of skewing or shifting of the above-mentioned recording sheet between the above-mentioned re-conveyance path and the above-mentioned image carrier section and a control means which judges it to be malfunctional if the above-mentioned skewing amount or shifting amount is more than regulation and which also modifies image forming conditions thereafter. By means of aforesaid detection means, the amount of skewing or shifting of the above-mentioned recording sheet between the above-mentioned re-conveyance path and the above-mentioned image carrier section is optically detected and, if the above-mentioned skewing amount or shifting amount is more than regulation, aforesaid control means judges to be malfunctional and modifies image forming conditions thereafter. Due to the above, even if skewing or shifting occurs, enhancement efficiency of copying operation and reliability can be improved.

Structure 2 is characterized in that, in Structure 1, providing with a collating device having a staple sort mode which aligns plural recording sheet and binds them and releasing the above-mentioned staple sort mode when the above-mentioned skew amount or shift amount is more than regulation. As described above, control in which the staple sort mode is canceled when the above-mentioned skew amount or shift amount is more than regulation and defects in stapling which align plural recording sheet and bind them are conducted and collating are continued without stopping copying operation.

Structure 3 is characterized in, in Structure 1, providing a register control section which registers the position of an image on an image carrier and the above-mentioned recording sheet, compulsorily forms the upward curl for correcting skewing of the above-mentioned recording sheet and feed the recording sheet while removing the above-mentioned skewing and feeding the recording sheet by means of the above-mentioned control means while forming an upward curl on the above-mentioned recording sheet when the above-mentioned skewing amount is more than regulation. As described above, a recording sheet is fed wherein an image on the image carrier is registered with the above-mentioned recording sheet and the upward curl is compulsorily formed so that skewing is removed. When the skewing amount is more than regulation, the recording sheet is fed while forming an upward curl on aforesaid recording sheet for controlling to prevent wrinkle of the recording sheet.

Structure 4 is characterized in, in Structure 1, providing a non-stacking type automatic duplex unit does not provide for correction of skewing but optically detects the skewing amount or the shifting amount of the above-mentioned recording sheet fed from the above-mentioned automatic duplex unit by the above-mentioned detection means. As described above, due to optically detecting the skew amount or the shift amount of recording sheet fed from the automatic duplex unit, enhancement of efficiency of copying operation and improvement in terms of reliability become possible in a non-stacking type automatic duplex unit which had conventionally high possibility to occur skewing or shifting in accordance with prior art.

DETAILED DESCRIPTION OF THE PREFERRED EMBODIMENT

Figure 1:
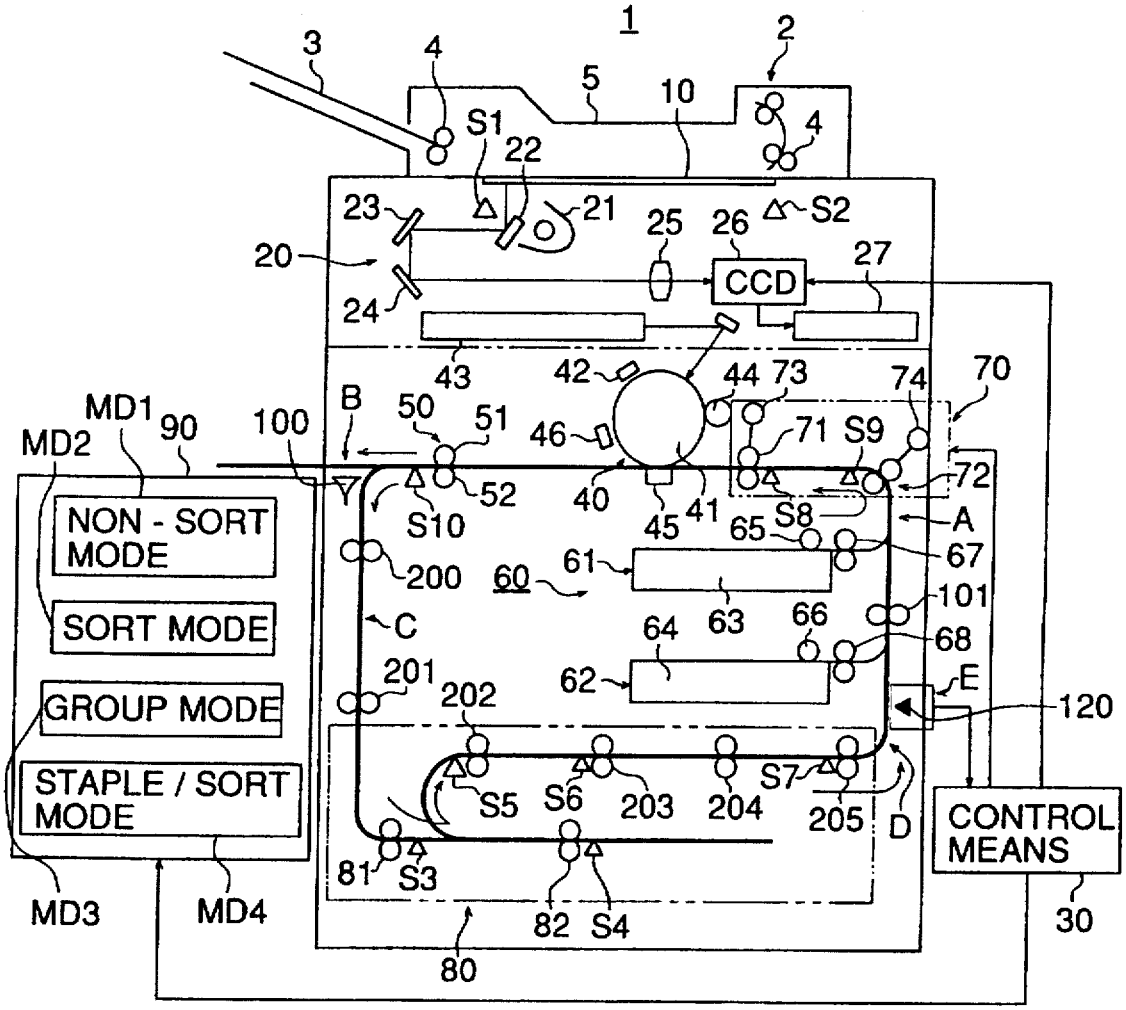
FIG. 1 is a schematic diagram of an image forming apparatus.
Figure 2:
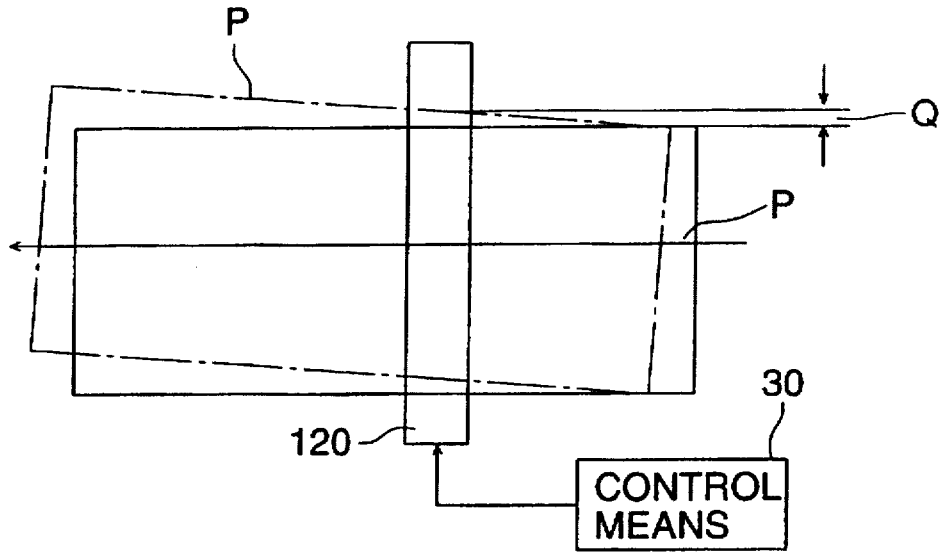
FIGS. 2(*a*) and 2(*b*) are schematic diagrams of a skewing amount or shifting amount detection respectively.
Figure 2:
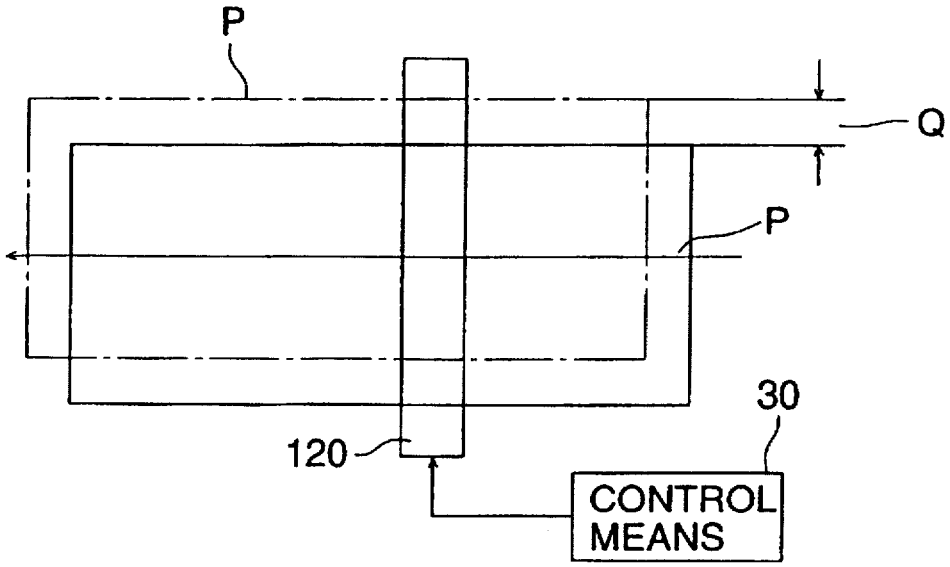
Figure 3:
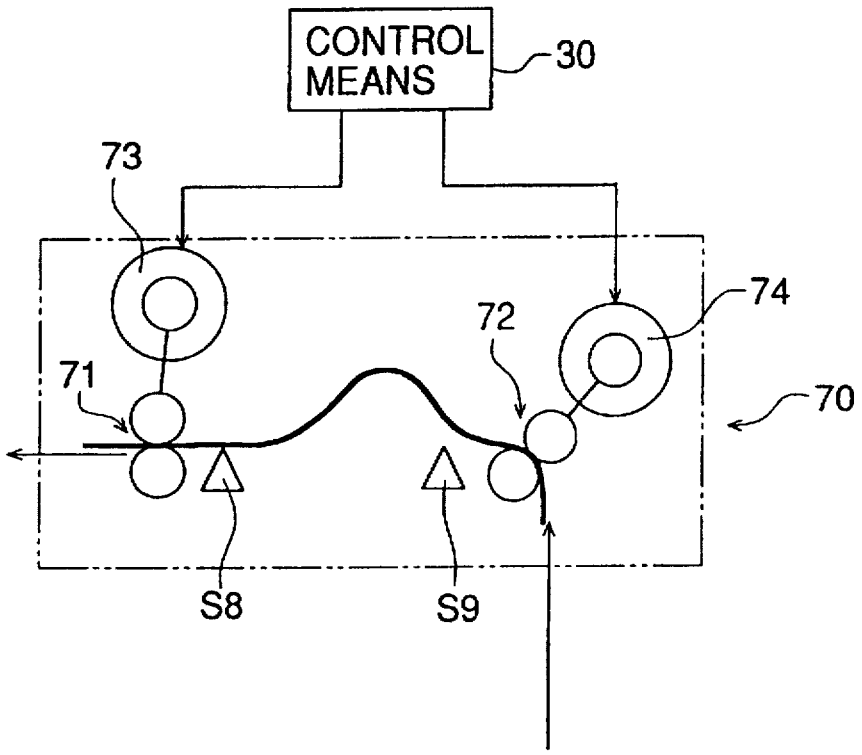
FIG. 3 is a schematic diagram of a register control section.

Hereinafter, examples of the image forming apparatus of the present invention will be explained in detail referring to respective drawings. FIG. 1 is a schematic diagram of an image forming apparatus. FIGS. 2(*a*) and 2(*b*) are schematic diagrams of a skew amount or shifting amount sensing section. FIG. 3 is a schematic diagram of a resister control section. In this Example, a copying machine is used as image forming apparatus 1. Image forming apparatus 1 is provided with automatic document feeding section 2. Automatic document feeding section 2 is provided with original tray 3, conveyance roller 4 and discharging stand 5. An original placed onto original tray 3 is conveyed to original placing glass 10 automatically one by one due to driving of conveyance roller 4. The original wherein image reading is finished is sent to discharging stand 5.

In image forming apparatus 1, image information reading section 20 which reads image information of the original conveyed is provided. Image information reading section 20 is provided with light source 21, mirrors 22–24, lens 25 and CCD 26. Light source 21 and mirrors 22–24 are located below original placing glass 10 capable of moving forward and backward. Light source irradiates the original on original placing glass 10. The reflected light is optically read by CCD 26 through an optical system composed of mirrors 22 24 and lens 25. Below both end of original placing glass 10, position sensing sensors S1 and S2 are position for moving light source 21 forward and backward. When these position sensing sensors S1 and S2 detect light source 21, light source 21 is moved to the opposite direction. CCD 26 is controlled by control means 30, storing image signals read in image storing section 27.

Image forming apparatus 1 is provided with image carrier section 40, fixing section 50, paper feeding section 60, register control section 70, automatic duplex unit (ADU) 80 and discharging and collating device 90. It also has conveyance path A which conveys a recording sheet to image carrier section 40, discharging path B which discharges the recording sheet wherein images are formed outside the apparatus, circulation reversal paper feeding path C for circulating the recording sheet wherein images are formed in image carrier section 40 to automatic duplex unit (ADU) 80 and re-conveyance path D from automatic duplex unit (ADU).

In image carrier section 40, photoreceptor drum 40 as an image carrier is provided. In photoreceptor drum 41, uniform electrical charging is provided by means of electrode 42 for charging. By image information recording section 43, image information is irradiated on the circumference of photoreceptor drum 41 for forming static latent images. Image information recording section 43 is so structured that image information stored in image storing section 27 on the circumference of photoreceptor drum 41.

Static latent images are developed in developing section 44 for forming toner images. In synchronisity with rotation of photoreceptor drum 41, a recording sheet is sent to transfer section 45 for transferring toner images. Following this, the recording sheet is separated from photoreceptor drum 41, and then conveys it to the following fixing section 50. In proximity to photoreceptor drum 41, cleaning section 46 is provided for cleaning the surface of photoreceptor drum 41 after being transferred. For the next image forming, the photoreceptor is charged again with electrode 42.

Fixing section 50 is comprised of a paired rollers 51 and 52, wherein a recording sheet is heated and toner images are fixed on a pressed recording sheet. By means of switching gate 100 located following fixing section 50, conveyance path of recording sheet is switched between discharging side and re-conveyance side. Switching gate 100 is switched by sensing the recording sheet by sensor S10.

In paper feeding section 60, plural paper feeding step section 61 and 62 are provided. In this Example, it is provided upper section and lower section. In upper paper feeding step section 61 and lower paper feeding step section 62, trays 63 and 64 which respectively house the recording sheet are provided. Above recording sheet on upper paper feeding step section 61 and lower paper feeding step section 62, paper feeding rollers 65 and 66 are respectively provided so that recording sheet is fed out intermittently. Before each of paper feeding rollers 65 and 66, double feeding preventing paired rollers 67 and 68 are located so that recording sheet is fed to conveyance path individually. In conveyance path A, conveyance paired roller 101 is provided.

In automatic duplex unit (ADU) 80 is provided with conveyance roller pair 81, reversal roller pair 82, conveyance roller pairs 202, 203, 204 and 205 and sensors S3, S4, S5, S6 and S7. Recording sheet sent from circulation reversal paper feeding path C is conveyed in forward rotation of conveyance-in roller pair 81 and reversal roller pair 82, and due to the reverse rotation of reversal roller pair 82 and driving of conveyance roller pairs 202, 203, 204 and 205, the recording is conveyed out to re-conveyance path D. As described above, a non-stack system is adopted. Compared with a conventional stack system wherein a recording sheet in which copying has been finished on one side is temporarily stacked, this non-stack system does not stack. Therefore, there occurs no time loss for copying the front side and rear side of the recording sheet. Producibility is improved, and the recording sheet can always be gripped on a roller. Accordingly, the occurrence of jamming due to curling of recording sheet which easily occurs by fixing section 50 can be prevented.

In circulation reversal paper feeding path C, conveyance roller pair 200 and 201 are provided. Between re-conveyance path D and image carrier section 40, skew amount or shift amount sensing section E is provided. Skew amount or shift amount sensing section E is constituted as shown in FIGS. 2(*a*), 2(*b*), wherein sensing means 120 is provided perpendicular to conveyance direction of recording sheet P so that skew amount or shift amount of recording sheet is optically detected. Namely, detecting means 120 is constituted of a transmitting type sensor, wherein plural pieces are provided at a prescribed interval in a perpendicular direction to conveyance direction of recording sheet. Due to this transmitting sensor, skew amount or shift amount Q of recording sheet P is optically detected. This skew amount or shift amount Q is sent to control means 30. Control means 30 evaluates that, if the above-mentioned skew amount or shift amount is more than the standard, it is evaluated to be malfunctional. By controlling register control section or discharging separating device 90, image forming conditions thereafter will be modified.

For optical detecting skew amount or shift amount Q, 48 pieces of photodiodes are located on a conveyance path at 1 mm pitch. By an infrared light source, when a recording sheet passes, the front edge of the recording sheet and a position 100 mm from the front edge of recording sheet are measured. If skew or shift of 3 mm or more is measured, control means 30 evaluates it as a malfunctional value, and recovery control described later is conducted.

In register control section 70, front register roller pair 71, rear register roller pair 72, sensors S8 and S9 are provided, as shown in FIGS. 1 and 3. Front register roller pair 71 and rear register roller pair 72 are independently driven by means of motors 73 and 74. The recording sheet conveyed is run into the front register roller pair 71. The image on the image carrier is registered with the recording sheet. Concurrently with this, in order to adjust skew of the recording sheet, an upward curl is compulsorily formed and fed in such a manner as to solve the above-mentioned skew.

It is ordinary that recording sheet conveyance speed in paper feeding section 60 or re-conveyance path D is higher than front register roller pair 71 and rear register roller pair 72 and thereafter. Namely, it is ordinary that register roller section 70 corrects skewing by providing sensors S8 and S9 at just before the rollers and protruding the recording sheet to the front register roller pair 71. The recording sheet is conveyed to the position of photoreceptor drum by re-actuating the front register roller pair 71 in synchronously with the timing of photoreceptor drum 41 and turning OFF rear register roller pair 72 so that the driving source on the paper feeding side is stopped. In this occasion, when skewing amount Q is larger than a prescribed amount, the recording sheet is deformed due to difference of conveyance speed and skewing correction. If the recording sheet is crushed by the register roller, wrinkles occurs. In accordance with this invention, by conducting recovery controlling wherein rear register roller pair 72 is actuated and concurrently with this the paper feeding driving source is intermittently actuated for constantly forming a certain amount of upward curl, wrinkles on the recording sheet can be prevented. As another means, it is easy to control to synchronize the paper feeding speed with the register speed only when skewing malfunction occurs. Ordinarily, to make same the paper feeding speed and the register speed is not conducted because time required for a period since "Copy ON" until discharging is finished is too long.

Recovery control of discharging collating device 90 is conducted as follows. Discharging collating device 90 is ordinarily include mode MD1 through MD4, i.e., non-sort mode/sort mode/group mode/staple mode. Among them, staple sort mode MD4 temporarily aligns each recording sheet discharged. After aligning four corners, it staples one point. However, if skewing cannot be sufficiently corrected in register control section 70, recording media are discharged on the discharging device while being curved. Thus, even when aligning is attempted, four corners are not aligned. As a result, staple error is resulted in. After stapling, staple bundle discharging operation is conducted. If there is an error here, this error may lead to more larger in-alignment or jamming. Accordingly, when skewing amount or shifting amount is detected to be more than a prescribed amount, staple sort mode MD four is automatically canceled and automatically moves to sort mode MD2 which only conducts collating. Due to this, collating is conducted though stapling is not conducted. Therefore, the occurrence of the above-mentioned defect can be prevented in advance.

As described above, by detecting skew amount or shift amount and conducting recovery controlling, image defect on a discharge recording sheet and jamming can be prevented in advance.

As described above, Structure 1 is that, by means of aforesaid detection means, the amount of skewing or shifting of the above-mentioned recording sheet between the above-mentioned re-conveyance path and the above-mentioned image carrier section is optically detected and, if the above-mentioned skewing or shifting amount is more than regulation, aforesaid control means judges to be malfunctional and modifies image forming conditions thereafter. Due to the above, even if skewing or shifting occurs, enhancement efficiency of copying operation and reliability can be improved.

Structure 2 is, in Structure 1, to conduct control in which the staple sort mode is canceled when the above-mentioned skew amount or shift amount is more than regulation and control which prevents defective stapling in which plural recording sheet are aligned and bound them and also discharging and collating are continued without stopping copying operation.

Structure 3 is, in Structure 1, that a recording sheet is fed wherein an image on the image carrier is registered with the above-mentioned recording sheet and upward curl is compulsorily formed so that skewing is removed. When the skewing amount is more than regulation, the recording sheet is fed while forming an upward curl on aforesaid recording sheet for controlling to prevent wrinkle of the recording sheet.

Structure 4 is that, in Structure 1, due to optically detecting skewing amount or shifting amount of recording sheet from the automatic duplex unit, enhancement of efficiency of copying operation and improvement in terms of reliability become possible in a non-stack type automatic duplex unit which had conventionally high possibility to occur skewing or shifting in accordance with prior art.

What is claimed is:

1. An image forming apparatus comprising:

(a) an image carrier for forming an image thereon;

(b) sheet feeding means for feeding a recording sheet to the image carrier to transfer the image onto the recording sheet;

(c) reversing means for reversing the recording sheet on one side of which the image has been transferred and fixed, at a conveyance path in the reversing means and for feeding the recording sheet onto the image carrier to form another image on a rear side of the recording sheet;

(d) detection means provided between the conveyance path and the image carrier for optically detecting an amount of skew or an amount of shift in a direction perpendicular to a conveyance direction of the recording sheet; and (e) control means for judging the amount of skew or the amount of shift to be malfunctional when the amount of skew or the amount of shift exceeds a predetermined value, and for changing image forming conditions in accordance with the judged amount thereafter.

2. The apparatus of claim 1 further comprising:

collating means having a staple sort mode in which plural recording sheets are aligned and the plural recording sheets are bound together, wherein the image forming condition are under the staple sort mode, the control means controls the collating means to release the staple sort mode when the amount of skew or the amount of shift exceeds the predetermined value.

3. The apparatus of claim 1 further comprising:

a non-stack type automatic duplex unit in which correction of skewing of the recording sheet is not conducted, wherein the detecting means optically detects the amount of skew of the recording sheet conveyed from the automatic duplex unit.

4. The apparatus of claim 1 further comprising:

a register controller for registering the recording sheet with a position of the image on the image carrier, for compulsorily forming an upward curl to correct skewing of the recording sheet, and for conveying the recording sheet so that the amount of skew decreases, wherein the control means controls the register controller to convey the recording sheet while forming the upward curl when the amount of skew exceeds the predetermined value.

5. The apparatus of claim 4, wherein the register controller comprises:

first paired register rollers for compulsorily forming the upward curl to correct skewing of the recording sheet; and second paired register rollers provided on a downstream side of the first paired register rollers relating to a conveying direction of the recording sheet for compulsorily forming the upward curl to correct skewing of the recording sheet, and wherein when the amount of skew exceeds the predetermined value, the control means controls both first and second register rollers to convey the recording sheet so that a prescribed amount of upward curl is formed.

6. The apparatus of claim 5, wherein the control means controls a feeding speed of the feeding means to be in synchronization with a register speed of the first and second register rollers, only when the amount of skew exceeds the predetermined value.

* * * * *